US010299588B1

(12) United States Patent
Lai et al.

(10) Patent No.: US 10,299,588 B1
(45) Date of Patent: May 28, 2019

(54) MODULAR FRAME WITH A U-SHAPED HOOK MEMBER

(71) Applicant: Shenter Enterprise Co., Ltd., Chang-Hua Hsien (TW)

(72) Inventors: Ming-Hsiao Lai, Chang-Hua Hsien (TW); Kuo-Shu Huang, Changhua (TW)

( * ) Notice: Subject to any disclaimer, the term of this patent is extended or adjusted under 35 U.S.C. 154(b) by 0 days.

(21) Appl. No.: 16/030,380

(22) Filed: Jul. 9, 2018

(51) Int. Cl.
*A47B 95/00* (2006.01)
*A47B 96/14* (2006.01)

(52) U.S. Cl.
CPC ..... *A47B 95/00* (2013.01); *A47B 96/1433* (2013.01); *A47B 96/1441* (2013.01); *A47B 2220/0002* (2013.01)

(58) Field of Classification Search
CPC . A47B 95/00; A47B 96/1433; A47B 96/1441; A47B 2220/0002; A47B 96/063; A47B 96/02; A47B 2220/0036; A47B 57/40; A47B 96/06; F16B 12/32
See application file for complete search history.

(56) References Cited

U.S. PATENT DOCUMENTS 4,317,523 A * 3/1982 Konstant ..... A47B 57/402 108/107
4,934,858 A * 6/1990 Beaulieu ..... F16B 12/40 403/174
6,253,933 B1 * 7/2001 Yang ..... A47B 57/545 108/147.12
8,739,986 B2 * 6/2014 Preidt ..... A47F 5/00 108/187
9,247,809 B1 * 2/2016 Hsu ..... A47B 47/0083
10,093,449 B2 * 10/2018 Han ..... B65D 19/38
2017/0340114 A1 * 11/2017 Choi ..... A47B 47/00
2018/0289151 A1 * 10/2018 Dahatonde ..... A47B 47/0083

FOREIGN PATENT DOCUMENTS

KR 1845976 B1 * 4/2018

* cited by examiner

*Primary Examiner* — Ko H Chan
(74) *Attorney, Agent, or Firm* — Egbert Law Offices, PLLC

(57) ABSTRACT

A modular frame with a U-shaped hook member includes multiple upright columns each having at least two faces of each of the multiple upright columns have multiple couples of first through hole and second through hole defined therein. Multiple horizontal columns are respectively connected to a corresponding one of the at least two faces of a corresponding one of the multiple upright columns. Two connecting blocks respectively mounted into a corresponding one of two opposite ends of the tube. Two U-shaped hook members are respectively mounted into a corresponding one of the two connecting blocks. Each U-shaped hook member includes a first hook and a second hook extending therefrom and respectively engaged to a lower portion of a corresponding on of the first through holes and the second through holes.

8 Claims, 8 Drawing Sheets

MODULAR FRAME WITH A U-SHAPED HOOK MEMBER

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates to a modular frame, and more particularly to a modular frame with a U-shaped hook member.

2. Description of Related Art Including Information Disclosed Under 37 CFR 1.97 and 37 CFR 1.98

A conventional modular frame has three adjustable dimensions that are adjusted according to the space and the requirement such that the conventional modular frame is a convenient product for containing of displaying objects.

The conventional modular frame in accordance with the prior art includes four upright columns, two horizontal columns, two side column and a partition. The upright column has multiple faces each having multiple first engaging holes and second engaging holes defined therein. Each horizontal column has a first plate. The first plate has two opposite ends each having a first hook vertically extending therefrom. Each first hook has a first indentation defined therein, wherein the first indentation is engaged to the first engaging hole and a third engaging hole is defined in the first hook. Each side column has a second plate. The second plate has two opposite ends each having a second hook extending therefrom and a second indentation defined in the second hook. The partition is rectangular and disposed on the two horizontal columns and the two side columns. The second engaging hole and the third engaging hole align with each other after the first hook of the horizontal column being engaged to the first engaging hole in the upright column. The second hook extends through the second engaging hole and the third engaging hole, and is engaged to the face of the upright column and the first plate for forming the modular frame.

However, the first plate is integrally formed with the horizontal column, and the second plate is integrally formed with the side column. For the strength of engaging relation, the horizontal column and the side column cannot be made of thin metal sheet such that cost of the horizontal column and the side column are raised. In addition, the manufacturer needs to prepare multiple molds with different size for the horizontal columns and the side columns with different specifications. As a result, the price of the conventional modular frame is raised because the cost of the molds is very expensive.

The present invention has arisen to mitigate and/or obviate the disadvantages of the conventional modular frame.

BRIEF SUMMARY OF THE INVENTION

The main objective of the present invention is to provide an improved modular frame that has a U-shaped hook member for connecting an upright column and a horizontal column.

To achieve the objective, the modular frame with a U-shaped hook member in accordance with the present invention comprises multiple upright columns each having a polygonal cross-section and multiple faces. At least two faces of each of the multiple upright columns have multiple couples of first through hole and second through hole defined therein, wherein the coupled first through hole and second through hole horizontally correspond to each other and the multiple couples of first through hole and second through hole are longitudinally arranged in upright column. Multiple horizontal columns are respectively connected to a corresponding one of the at least two faces of a corresponding one of the multiple upright columns. Each of the multiple horizontal columns includes a tube having a rectangular cross section. The tube has two long sides and two short sides, wherein the two long sides of the tube is parallel to an axis of the corresponding upright column. Two connecting blocks respectively mounted into a corresponding one of two opposite ends of the tube. Two U-shaped hook members are respectively mounted into a corresponding one of the two connecting blocks. Each U-shaped hook member includes a first wing plate and a second wing plate connected to each other by a bridge for forming a U-shaped structure. The first wing plate has a first hook extending therefrom and the second wing plate has a second hook extending therefrom. The first hook and the second hook respectively downward extend and engaged to a lower portion of a couple of first through hole and second through hole.

Further benefits and advantages of the present invention will become apparent after a careful reading of the detailed description with appropriate reference to the accompanying drawings.

DETAILED DESCRIPTION OF THE INVENTION

Figure 1:
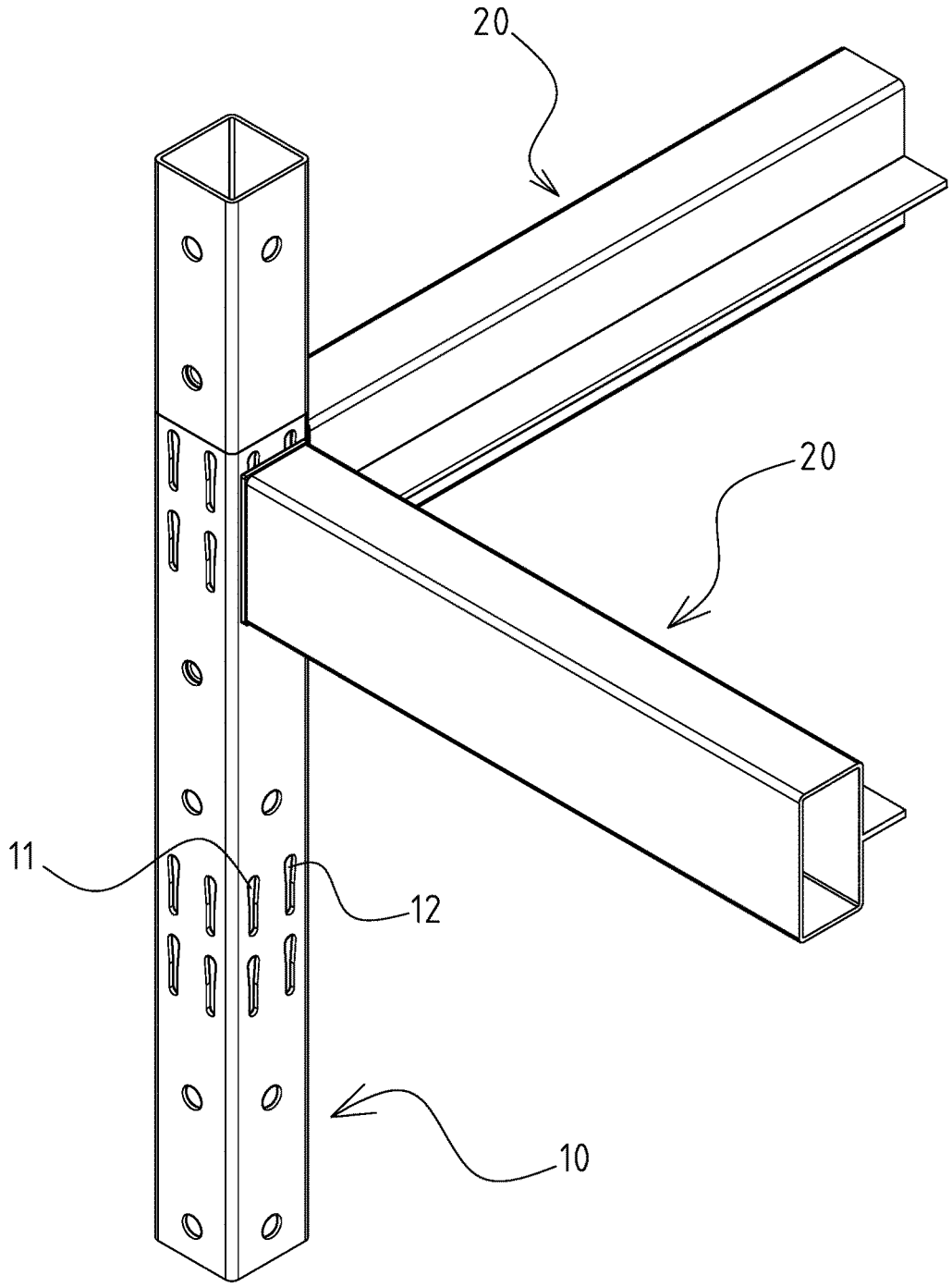
FIG. 1 is a partially perspective view of a modular frame with a U-shaped hook member in accordance with the present invention.
Figure 2:
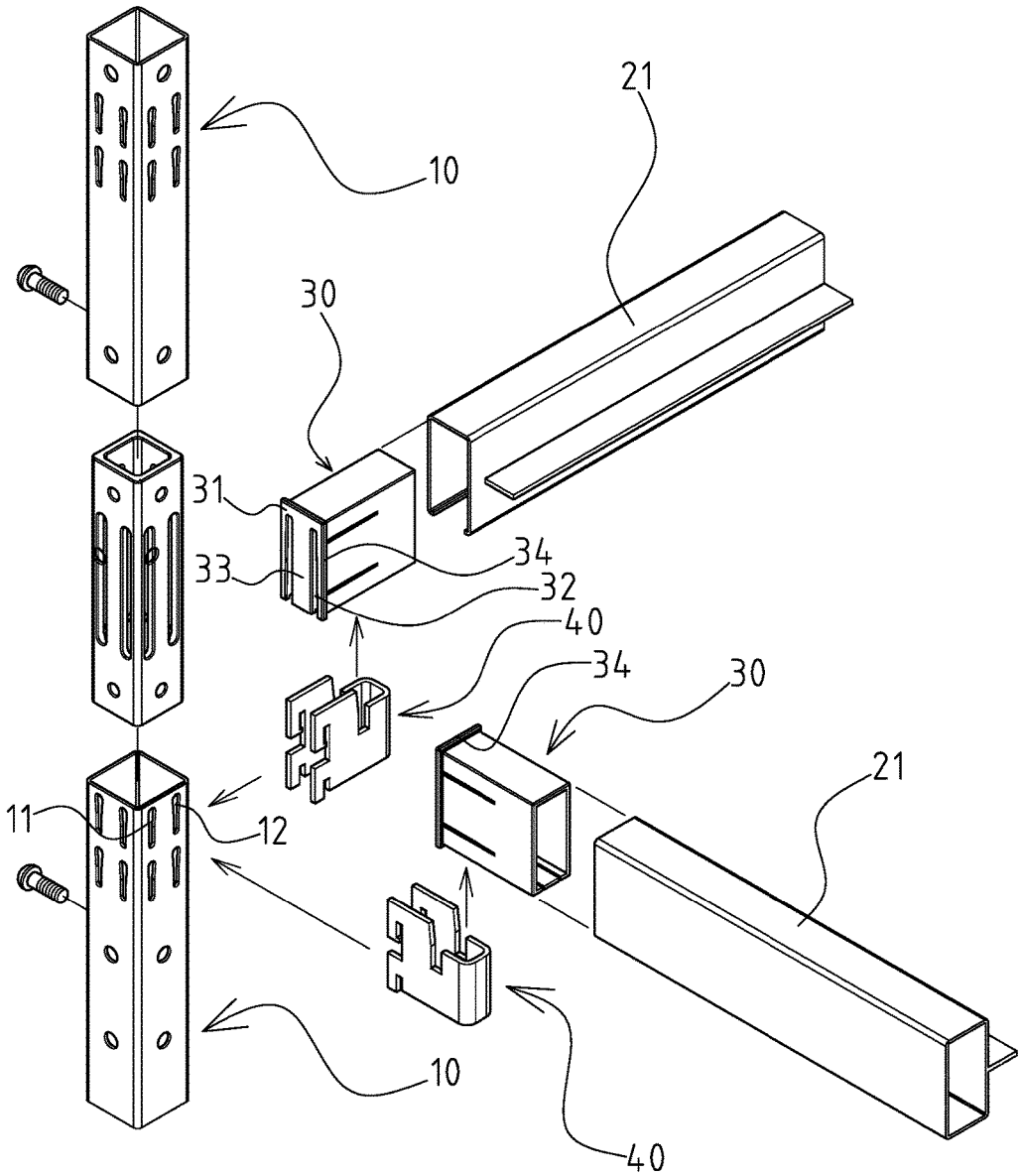
FIG. 2 is an exploded perspective view of the modular frame with a U-shaped hook member in FIG. 1.
Figure 3:
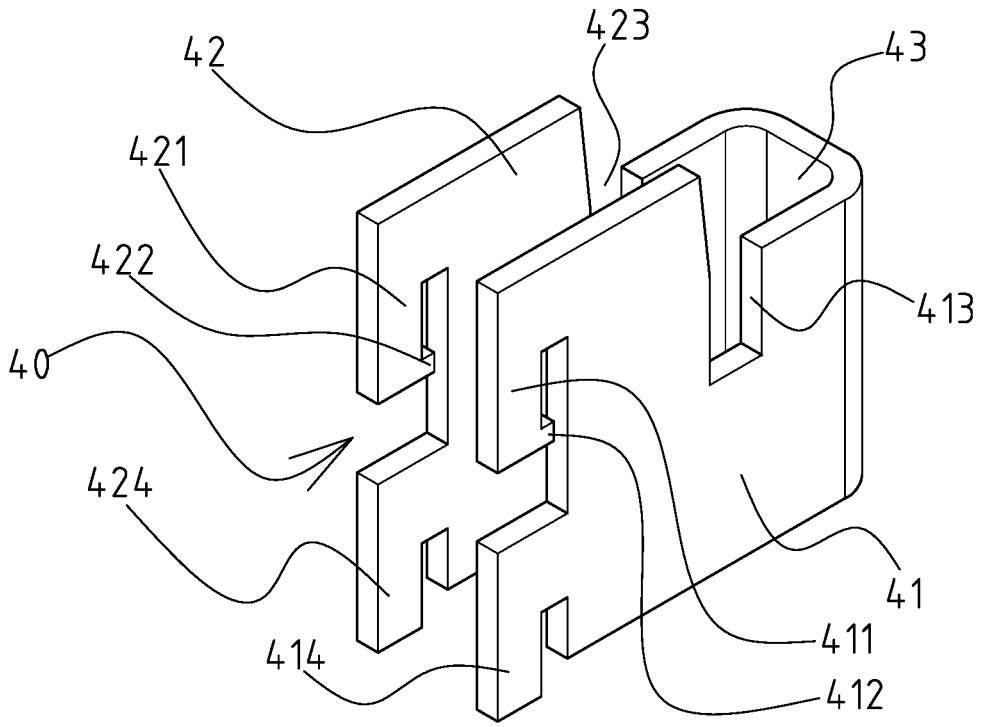
FIG. 3 is a perspective view of a U-shaped hook member of the modular frame in accordance with the present invention.
Figure 6:
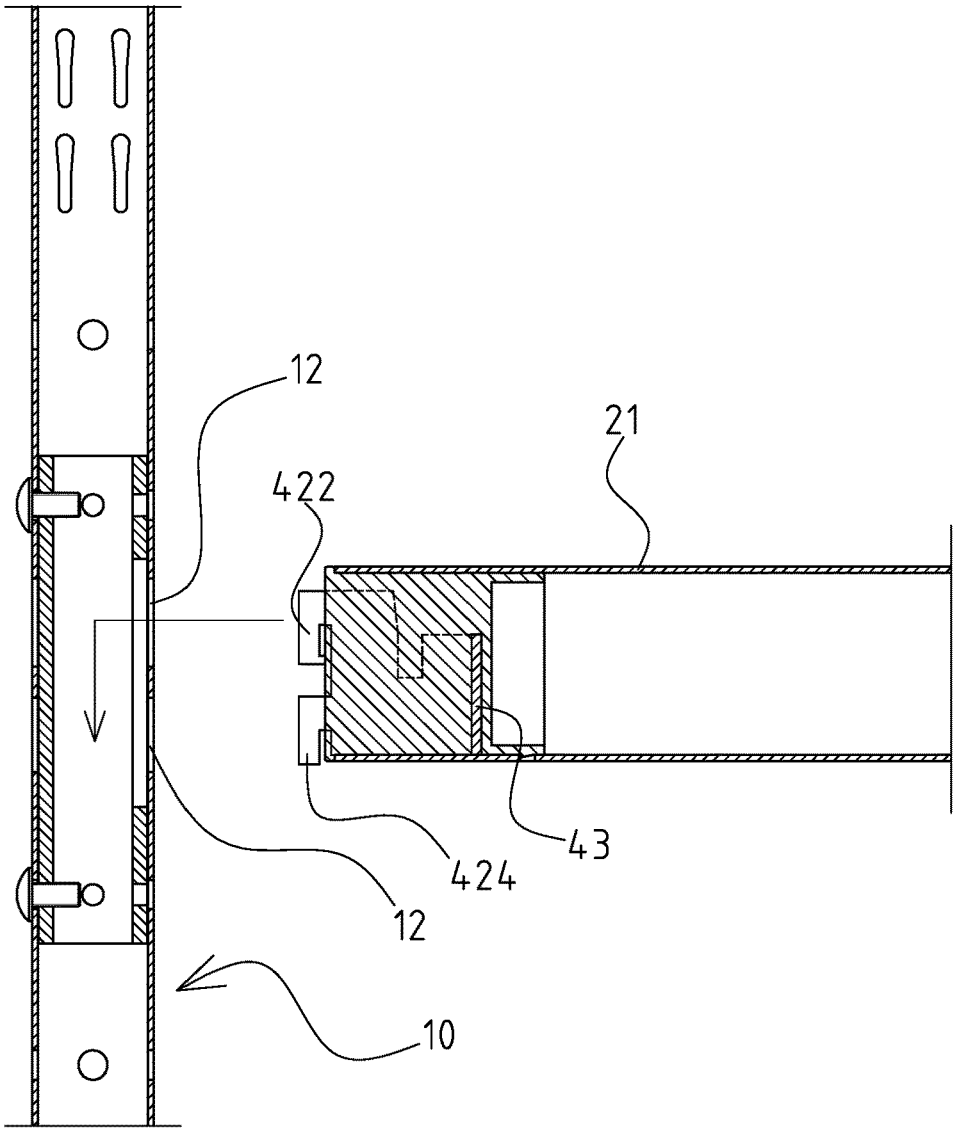
FIG. 6 is an operational view of the modular frame with a U-shaped hook member in accordance with the present invention when assembling the upright column and the horizontal column.
Figure 7:
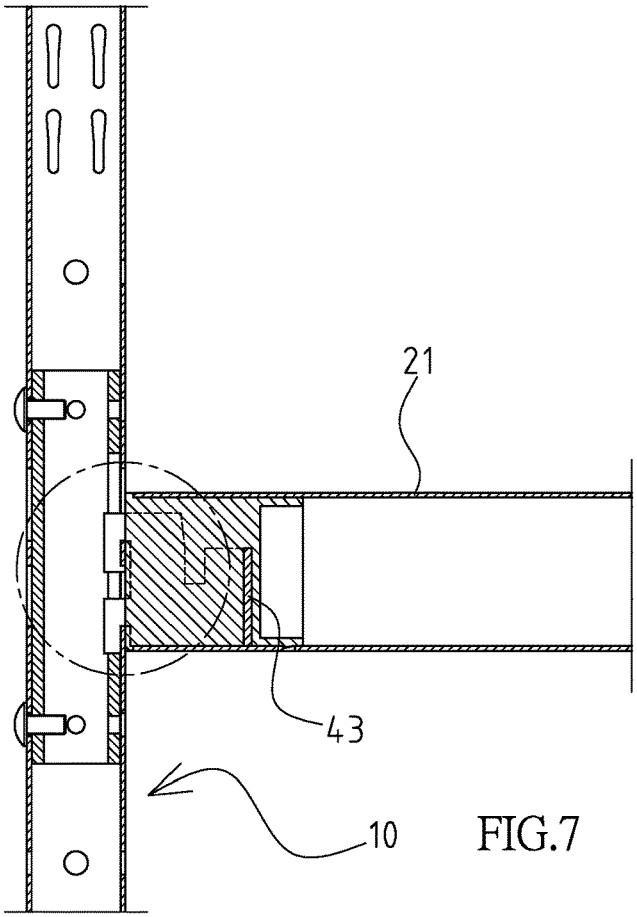
FIG. 7 is a partially cross-sectional view of the modular frame with a U-shaped hook member in accordance with the present invention.
Figure 7A:
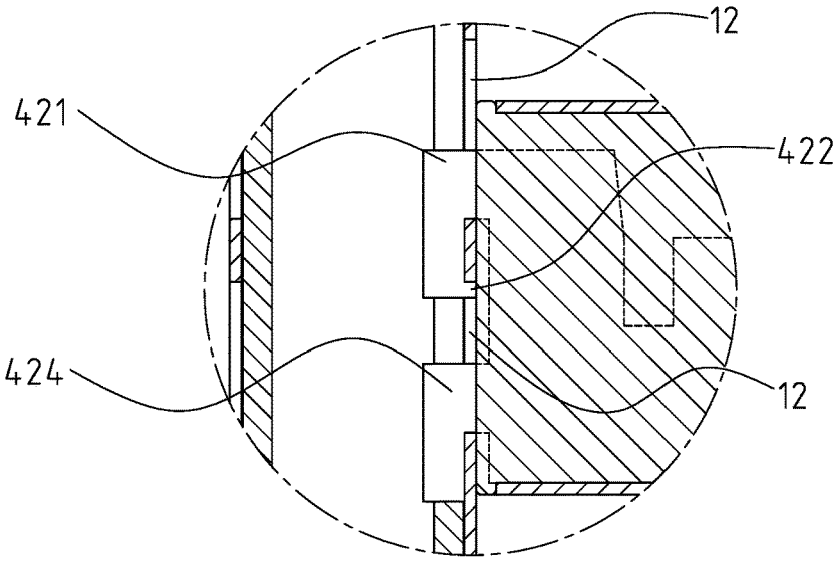
FIG. 7A is a partially enlarged view of the FIG. 7.

Referring to the drawings and initially to FIGS. 1-3, a modular frame with a U-shaped hook member in accordance with the present invention comprises multiple upright columns 10 each having a polygonal cross-section and multiple faces. At least two faces of each of the multiple upright columns 10 have multiple couples of first through hole 11 and second through hole 12 defined therein, wherein the coupled first through hole 11 and second through hole 12 horizontally correspond to each other and the multiple couples of first through hole 11 and second through hole 12 are longitudinally arranged in upright column 10. Multiple horizontal columns 20 are respectively connected to a corresponding one of the at least two faces of a corresponding one of the multiple upright columns 10. Each of the multiple horizontal columns 20 includes a tube 21 having a rectangular cross section. The tube 21 has two long sides and two short sides, wherein the two long sides of the tube 21 is parallel to an axis of the corresponding upright column 10. Two connecting blocks 30 respectively mounted into a corresponding one of two opposite ends of the tube 21. Two U-shaped hook members 40 are respectively mounted into a corresponding one of the two connecting blocks 30. Each U-shaped hook member 40 includes a first wing plate 41 and a second wing plate 42 connected to each other by a bridge 43 for forming a U-shaped structure. The first wing plate 41 has a first hook 411 extending therefrom and the second wing plate 42 has a second hook 421 extending therefrom. With reference to FIGS. 6, 7 and 7A, the first hook 411 and the second hook 421 respectively downward extend and engaged to a lower portion of a couple of first through hole 11 and second through hole 12. In the preferred embodiment of the present invention, the first through hole 11 and the second through hole 12 respectively have a narrowed lower portion for stably holding the first hook 411 and the second hook 421 in place.

A first protrusion 412 extends from a free end of the first hook 411 and hooks an upper edge of a corresponding one of the first through holes 11. A second protrusion 422 extends from a free end of the second hook 421 and hooks an upper edge of a corresponding one of the second through holes 12.

Figure 4:
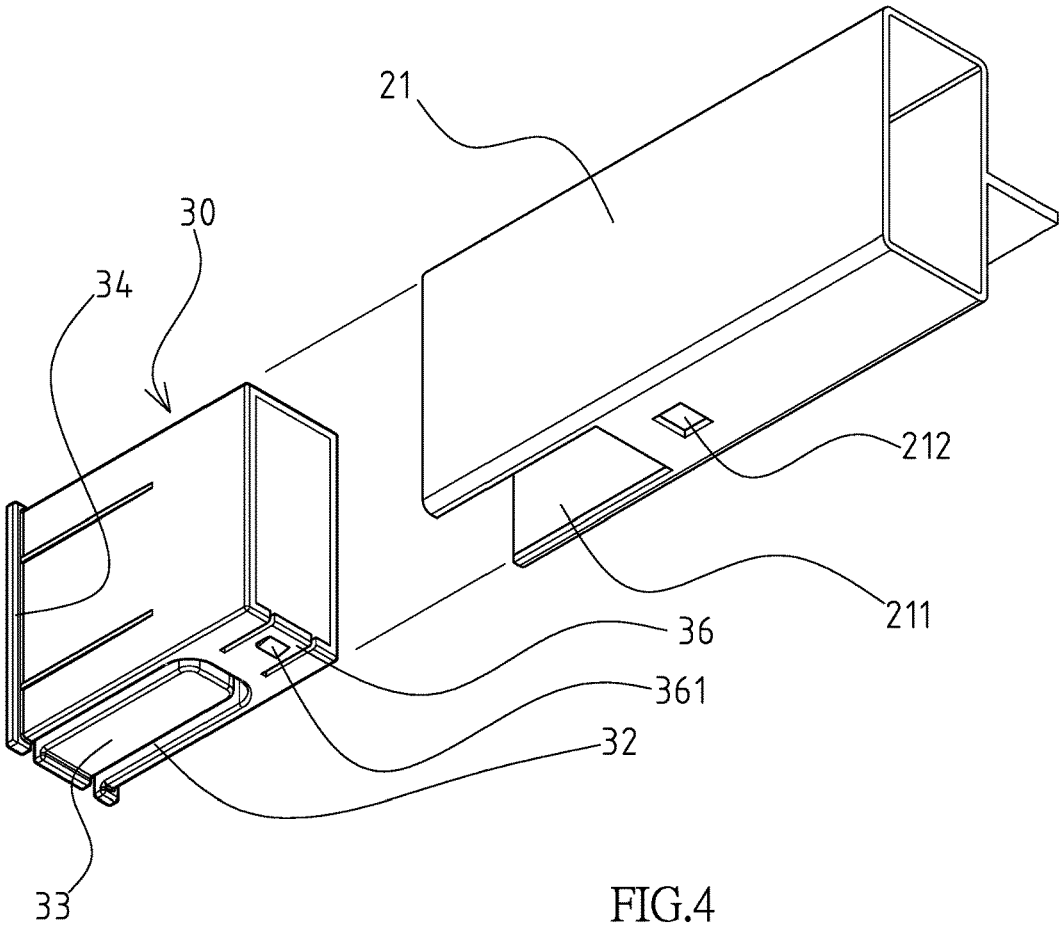
FIG. 4 is an exploded perspective view of a horizontal column of the modular frame with a U-shaped hook member in accordance with the present invention.
Figure 4A:
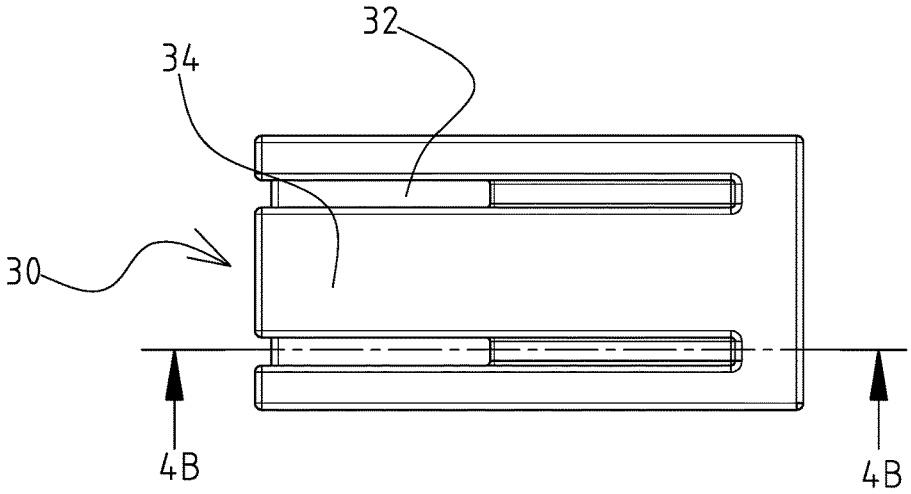
FIG. 4A is bottom plan view of a connecting block of the modular frame with a U-shaped hook member in accordance with the present invention.
Figure 4B:
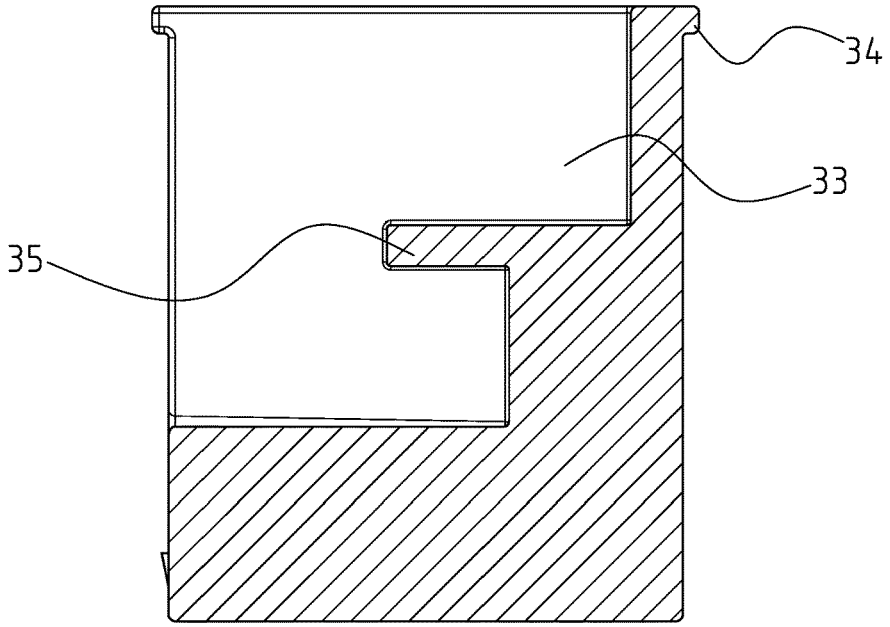
FIG. 4B is a cross-sectional view of the connecting block in FIG. 4A along line 4B-4B.
Figure 5:
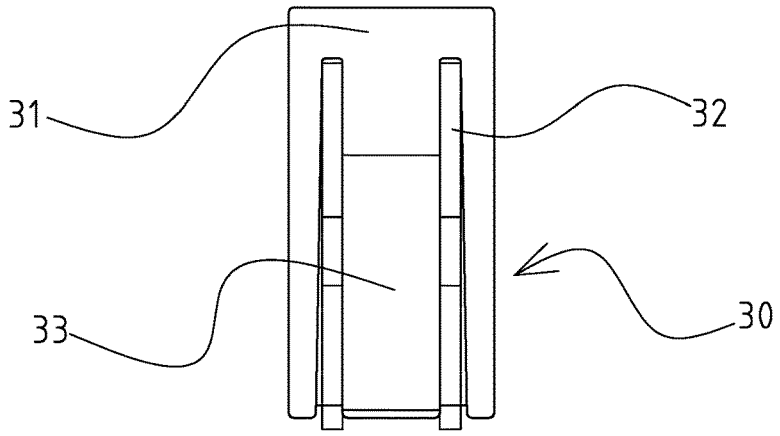
FIG. 5 is a front plan view of the connecting block of the modular frame with a U-shaped hook member in accordance with the present invention.

Further with reference to FIGS. 4, 4A and 4B, each of the connecting blocks 30 is formed with a front face 31 corresponding to the upright column 10. The front face 31 of each of the connecting blocks 30 has a U-shaped slot 32 defined therein and formed with a wedged stub 33, wherein the U-shaped slot 32 extends to a bottom and the front face 31 of a corresponding one the connecting blocks 30. The wedged stub 33 pushes the bridge 43 of the U-shaped hook member 40 for promoting the connection between the connecting block 30 and the U-shaped hook member 40 when the U-shaped hook member 40 is mounted into the U-shaped slot 32 in the connecting block 30. A breach 211 is defined in a bottom of each end of the tube 21. Each U-shaped hook member 40 is mounted into the corresponding connecting block 30 and partially received in the U-shaped slot 32 via the breach 211. The front face 31 of each of the connecting blocks 30 has an annular lip 34 outwardly extending therefrom, wherein the annular lip 34 abuts against a distal end of the tube 21. Further with reference to FIG. 5, a cross-section of the U-shaped slot 32 in the front face 31 is gradually narrowed relative to a height thereof for stably holding the U-shaped hook member 40 in place.

Further with reference to FIG. 4B, each connecting block 30 is formed with two protrusions 35 on two opposite sides of the U-shaped slot 32. The first wing plate 41 and the second wing plate 42 respectively has an indentation 413/423 defined therein, wherein each protrusion 35 is engaged into a corresponding one of the two indentations 413/423 when the U-shaped hook member 40 mounted into the corresponding connecting block 30. The bottom of the two opposite ends of the tube 21 has a bore 212 defined therein. Each connecting block 30 has a resilient plate 36 extending therefrom and the resilient plate 36 is formed with an engager 361, wherein the engager 361 is engaged into a corresponding one of the two bores 212 in the tube 21.

For enhancing the connections between the horizontal column 20 and the upright column 10, the first wing plate 41 of the U-shaped hook member 40 has a third hook 414 extending therefrom and the second wing plate 42 of the U-shaped hook member 40 has a fourth hook 424 extending therefrom, wherein the third hook 414 and the fourth hook 424 respectively longitudinally correspond to the first hook 411 and the second hook 421. The first hook 411 and the third hook 414 are respectively engaged to the lower portion of each of two adjacent first through holes 11, and the second hook 421 and the fourth hook 424 are respectively engaged to the lower portion of each of two adjacent second through holes 12.

Figure 8:
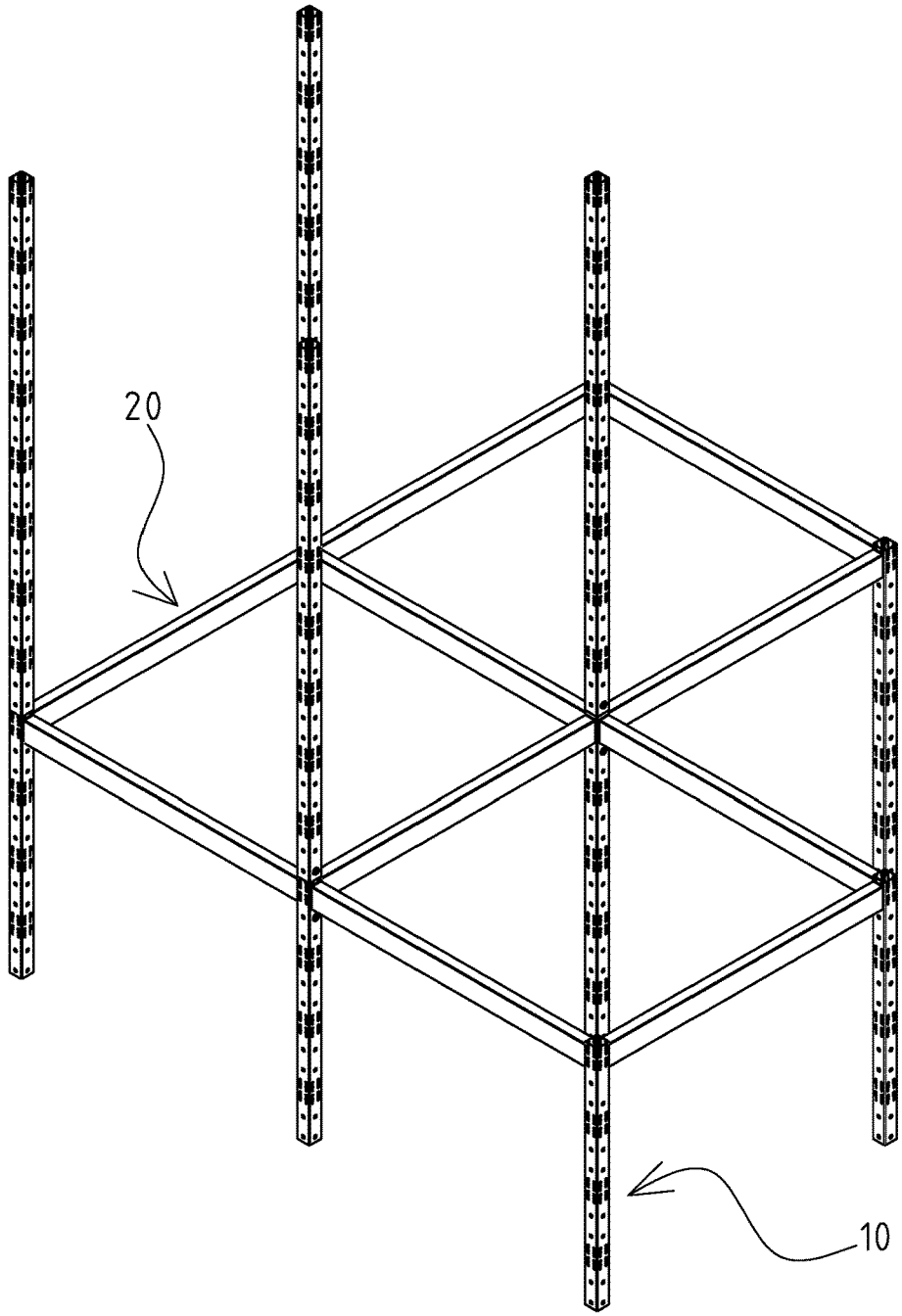
FIG. 8 is schematic view of the modular frame with a U-shaped hook member in accordance with the present invention.

With reference to FIGS. 2 and 8, the multiple horizontal columns 20 are mounted to the multiple upright columns 10 by the multiple connecting blocks 30 and the multiple U-shaped hook members 40 to form modular frame in accordance with the present invention, wherein the modular frame provides a storage function when a partition (not shown) is disposed on the multiple horizontal columns 20 that horizontally correspond to one another.

As described above, the modular frame in accordance with the present invention includes the following advantages.

1. The tube 21 of the horizontal column 20 is made of a metal tube that has a rectangular cross-section and the two long sides of the tube 21 is parallel to an axis of the corresponding upright columns 10 such that the tube 21 provides a better support strength to the upright columns 10. As a result, the thickness of the tube 21 can be properly reduced and the manufacturing cost of the tube 21 is reduces, accordingly.
2. The tubes 21, the connecting blocks 30 and the U-shaped hook members 40 in accordance with the present invention are respectively manufactured and sequentially assembled. Consequently, the tube 21 can be made of marketed metal tube and the length of the tube 21 can be willfully adjusted without preparing any mold such that manufacturing cost of the tube 21 is greatly reduced.

Although the invention has been explained in relation to its preferred embodiment, it is to be understood that many other possible modifications and variations can be made without departing from the spirit and scope of the invention as hereinafter claimed.

We claim:

1. A modular frame comprising:

a plurality of upright columns each having a polygonal cross-section and multiple faces, at least two faces of each of said plurality of upright columns having multiple couples of a first through hole and a second through hole defined therein, wherein the first through hole and second through hole horizontally correspond to each other and the multiple couples of the first through hole and the second through hole are longitudinally arranged in the upright column;

a plurality of horizontal columns respectively connected to a corresponding one of the at least two faces of a corresponding one of a said plurality of upright columns, each of the plurality of horizontal columns comprising:

a tube having a rectangular cross section, said rectangular cross section of said tube having two long sides and two short sides, wherein the two long sides of the tube are parallel to an axis of the corresponding upright column;

two connecting blocks respectively mounted into a corresponding one of two opposite ends of said tube;

two U-shaped hook members respectively mounted into a corresponding one of said two connecting blocks, each of said two U-shaped hook members having a first wing plate and a second wing plate connected to each other by a bridge so as to define a U-shaped structure, the first wing plate having a first hook extending therefrom and the second wing plate having a second hook extending therefrom, wherein the first hook and the second hook respectively extend downwardly and engage with a lower portion of the first through hole and the second through hole, wherein each of the two connecting blocks is formed with a front face corresponding to the corresponding upright column, the front face having a U-shaped slot defined therein and formed with a wedged stub, wherein the U-shaped slot extends to a bottom of the front face, the wedged stub pushing the bridge of one of the two U-shaped hook members so as to establish a connection between the connecting block and the one of the two U-shaped hook members when the one of the two U-shaped hook members is mounted into the U-shaped slot in the connecting block, a breach being defined in a bottom of each end of said tube, each of the two U-shaped hook members mounted into the corresponding connecting block and partially received in the U-shaped slot via the breach.

2. The modular frame of claim 1, wherein the front face of each of the connecting blocks has an annular lip extending outwardly therefrom, and wherein the annular lip abuts against a distal end of the tube.

3. The modular frame of claim 2, wherein each connecting block is formed with two protrusions on two opposite sides of the U-shaped slot, the first wing plate and the second wing plate respectively having an indentation defined therein, wherein each protrusion is engaged into a corresponding one of the two indentations when the one of the two U-shaped hook members is mounted into the corresponding connecting block.

4. The modular frame of claim 3, wherein a cross-section of the U-shaped slot in the front face is gradually narrowed relative to a height thereof for stably holding the one of the two U-shaped hook members in place.

5. The modular frame of claim 4, wherein a first protrusion extends from a free end of the first hook and hooks an upper edge of the first through hole, and wherein a second protrusion extends from a free end of the second hook and hooks an upper edge of the second through hole.

6. The modular frame of claim 5, wherein the first through hole and the second through hole respectively have a narrowed lower portion for stably holding the first hook and the second hook in place.

7. The modular frame of claim 6, wherein the bottom of the two opposite ends of said tube has a bore defined therein, and each connecting block has a resilient plate extending therefrom, the resilient plate being formed with an engager, wherein the engager is engaged into a corresponding one of the two bores in said tube.

8. The modular frame of claim 1, wherein the first wing plate of the one of the two U-shaped hook members has a third hook extending therefrom and the second wing plate of the one of the two U-shaped hook members has a fourth hook extending therefrom, the third hook and the fourth hook respectively longitudinally corresponding to the first hook and the second hook, wherein the first hook and the third hook are respectively engaged to the lower portion of each of two adjacent first through holes, and the second hook and the fourth hook are respectively engaged to the lower portion of each of two adjacent second through holes.

* * * * *